US005971605A

United States Patent [19]

Aoki et al.

[11] Patent Number: 5,971,605

[45] Date of Patent: Oct. 26, 1999

[54] DEVICE FOR MEASURING MEAN STAYING TIME

[75] Inventors: Yukihiro Aoki, Hyogo; Satoru Shibuya, Shiga, both of Japan

[73] Assignee: Giken Trastem Co., Ltd., Kyoto, Japan

[21] Appl. No.: 08/877,655

[22] Filed: Jun. 16, 1997

Related U.S. Application Data

[63] Continuation of application No. 07/790,483, Nov. 12, 1991, abandoned.

[30] Foreign Application Priority Data

Nov. 27, 1990 [JP] Japan ..... 2-327000

[51] Int. Cl.[6] ..... G07C 9/00

[52] U.S. Cl. ..... 368/89; 377/6; 340/545; 340/556

[58] Field of Search ..... 377/6; 340/545, 340/546; 368/89, 107

[56] References Cited

U.S. PATENT DOCUMENTS

| | | | |
|---|---|---|---|
| 4,000,400 | 12/1976 | Elder | 235/92 R |
| 4,122,331 | 10/1978 | Tsubota | 235/92 R |
| 5,138,638 | 8/1992 | Frey | 377/6 |

*Primary Examiner*—Bernard Roskoski
*Attorney, Agent, or Firm*—Koda & Androlia

[57] ABSTRACT

A device for measuring mean staying time of persons inside a building by processing signals from an entry/exit detector that outputs entry and exit signals when persons enter into and exit from the building. The device includes a staying measurer for determining the number of persons staying inside the building by subtracting the number of exit signals from the number of entry signals, an entry or exit measurer for determining the number of persons who have entered into or exited from the building by counting the entry or exit signals per predetermined period of time, and a calculating section for calculating the mean staying time of persons in the building during such a time period by dividing the number of persons staying inside at the time the unit time has expired by the number of persons who have exited.

2 Claims, 3 Drawing Sheets

DEVICE FOR MEASURING MEAN STAYING TIME

This application is a continuation of application Ser. No. 07/790,483, filed Nov. 12, 1991, now abandoned.

BACKGROUND OF THE INVENTION

1. Field of the Invention

The present invention relates to a device for measuring an average time period of people staying inside a building such as department stores, exhibition halls, etc. (hereinbelow, this time period is called a "mean staying time").

2. Prior Art

The device described in Japanese Patent Application Laid-Open (Kokai) No. 61-7675 is an example of an automatic device that measures the mean staying time.

As shown in FIG. 4, this device is made up by a detection means 1 and a processing means 2. The detection means 1, that comprises an entry-detector 11 and an exit-detector 12, is installed at an entrance/exit of a building (or a particular "establishment") and detects persons entering into and exiting out of the establishment. The processing means 2 processes the detection signals supplied from the detection means 1. The device further includes a timer 4 and a memory 3, etc. which are connected to the processing means 2 along with a display 5.

In the memory 3, the time at which an entry detection signal is generated by the entry-detector 11 is stored in the order of signals generated. The detection signal is generated when a person enters into the establishment. Also stored in the memory 3 is (a) the number of times persons exiting from the establishment detected by the exit-detector 12 and (b) the sum of the time difference between when persons entered and exited in the same order (that is, the sum of the time difference between a first person who entered and a first person who exited, a second person who entered and a second person who exited, and so on). Thus, the mean staying time is calculated by dividing the sum of such time difference by the number of persons who have exited (that is, by the number of persons who have exited as detected by the exit-detector 12). The mean staying time thus obtained is displayed on the display 5.

However, in this prior art measuring device, the entry time of a large number of persons who enter into the establishment must be read individually from the timer 4 and then stored in the memory 3. This causes problems. The overall size of the measuring device needs to be large because a large capacity is required for the memory 3 so as to store all the entry time information of persons who have entered into the establishment.

In addition, the prior art device measures (and displays) the mean staying time of persons who have entered between the time the entry thereinto started (e.g. the time a store is opened) and a specific time thereafter. As a result, the mean staying time during a particular time period of interest, or the mean staying time at a specific time, cannot be obtained. In other words, even though, a true mean staying time of each of various time periods of interest can make it possible to review the relationship between the mean staying time information and the amount of sales, etc., with the conventional devices, the mean staying time data cannot be used efficiently because they cannot measure the mean staying time at a particular time period.

SUMMARY OF THE INVENTION

Accordingly, the inventor of the present invention conducted diligent research in an attempt to solve the problems of the prior art device. As a result of the research, it was found that the "queuing theory", which is established as a theory applicable to a waiting line in a hospital waiting room, etc., can be utilized to solve the prior art problems. With the use of such a theory, the invention of the present application was created.

One object of the present invention is to provide a measuring device that measures a mean staying time of persons inside an establishment by processing signals supplied from an entry/exit detection means. The entry/exit detection means detects persons who have entered into and exited from the establishment and then supplies entry signals and exit signals, respectively, to the measuring device. In the measuring device, the mean staying time of persons inside the establishment is calculated without using entry or exit data of individuals. As a result of the non-use of such entry or exit data, the amount of memory capacity required to store an extremely large number of individual entry time information can be reduced, and the overall size of the device is thus reduced. Furthermore, according to the present invention, the mean staying time of any desired time period or at a particular point of time (or a value close to this mean staying time) is able to be ascertained.

In order to accomplish the object, a unique structure for the measuring device of the present invention is provided that includes:

(i) a staying measuring means for measuring the number of persons staying inside an establishment by subtracting the number of exit signals from the number of entry signals both supplied by entry/exit detection means, (ii) an entry measuring means which determines the number of persons who have entered into the establishment per a predetermined time period ("unit time") by counting the number of entry signals which are generated during such a unit time, and (iii) a calculation means that calculates the mean staying time of persons staying inside the establishment during the unit time by dividing the number of persons staying which is outputted by the staying measuring means right after the unit time has expired by the number of persons who have entered which is outputted by the entry measuring means.

The mean staying time thus obtained is displayed on a display.

The object of the present invention is also accomplished by another unique structure which includes:

(i) a staying measuring means for measuring the number of persons staying inside an establishment by subtracting the number of exit signals from the number of entry signals supplied by entry/exit detection means, (ii) an exit measuring means which determines the number of persons who have exited from the establishment per predetermined unit time by counting the number of exit signals which are generated during such a unit time, and (iii) a calculation means that calculates the mean staying time of persons staying inside the establishment during the unit time by dividing the number of persons staying which is outputted by the staying measuring means right after the unit time has expired by the number of persons who exited which is outputted by the exit measuring means.

The mean staying time thus obtained is displayed on a display.

DETAILED DESCRIPTION OF THE INVENTION

The principle of the first embodiment of the present invention is described below in accordance with FIG. 1.

Figure 1:
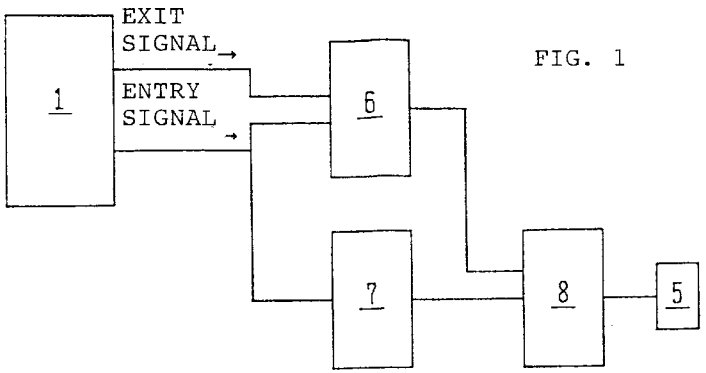
FIG. 1 is a conceptual diagram of the measuring device of the second embodiment of the present invention.

More specifically, the device shown in FIG. 1 includes a staying measuring means 6 which obtains the number of persons L staying by subtracting the number of exit signals from the number of entry signals.

The staying measuring means 6 is connected to an exit measuring means 9 which determines the number of persons who have exited per unit time by counting the number of exit signals in the unit time. A calculation means 90 is connected to the staying measuring means 6 and the exit measuring means 9. The calculation means 90 provides the mean staying time W by dividing the number of persons L staying (outputted by the staying measuring means 6) by the number of persons Y who have exited (which is outputted by the exit measuring means 9). The display 5 is connected to the calculation means 90 to show the obtained mean staying time.

In operation, the staying measuring means 6 determines the number of persons L staying by using the entry and exit signals outputted by the entry/exit detector 1.

The exit measuring means 9 counts the exit signals generated by the entry/exit detector 1 and measures the number of persons Y who have exited per unit time.

When the exit measuring means 9 finishes its counting of the number of persons Y who have exited per unit time, the calculation means 90 performs the calculation "Mean staying time W=Number of persons L staying divided by Number of persons Y who have exited {W=L/Y}".

The above calculation is performed based upon (i) the output (at the time when the unit time has passed) of the staying measuring means 6 (that is, the number of persons L who are staying inside the establishment) and (ii) the number of persons Y who have exited. The mean staying time W thus obtained is shown on the display 5.

The above calculation formula uses the "Number of persons Y who have exited".

As is clear from the description made with reference to the first embodiment, the mean staying time W obtained by the calculation means 90 is the mean staying time of persons staying inside an establishment within the unit time.

Thus, according this embodiment, it is also possible to reduce the overall size of the measuring device and to determine the mean staying time for any desired time period.

Next, a more detailed description of the present invention will be made with reference to FIGS. 2 and 3.

Figure 2:
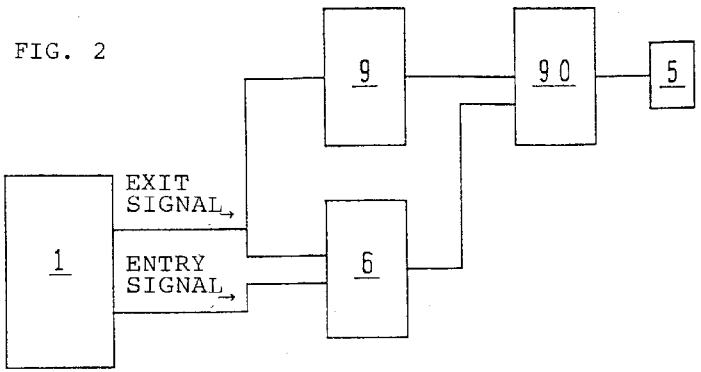
FIG. 2 is an explanatory diagram showing the entrance/exit of an establishment.

FIG. 2 illustrates the device of the present invention installed in a commercial establishment such as a department store, etc.

The entry/exit detector 1 is mounted to the ceiling near the entrance/exit B of the establishment. The detector 1 comprises a first sensor S1 and a second sensor S2. The sensors detect persons passing the entrance/exit B.

By this entry/exit detector 1, an entry signal is outputted when a person at the entrance/exit B passes underneath the entry/exit detector 1 in the order of the first sensor S1 and then the second sensor S2. Also, an exit signal is outputted when a person at the entrance/exit B passes underneath the entry/exit detector 1 in the order of the second sensor S2 and then the first sensor S1.

The output of the entry/exit detector 1 is supplied to a main processing unit 21, and a computer installed in the main processing unit processes the entry and exit signals.

Figure 3:
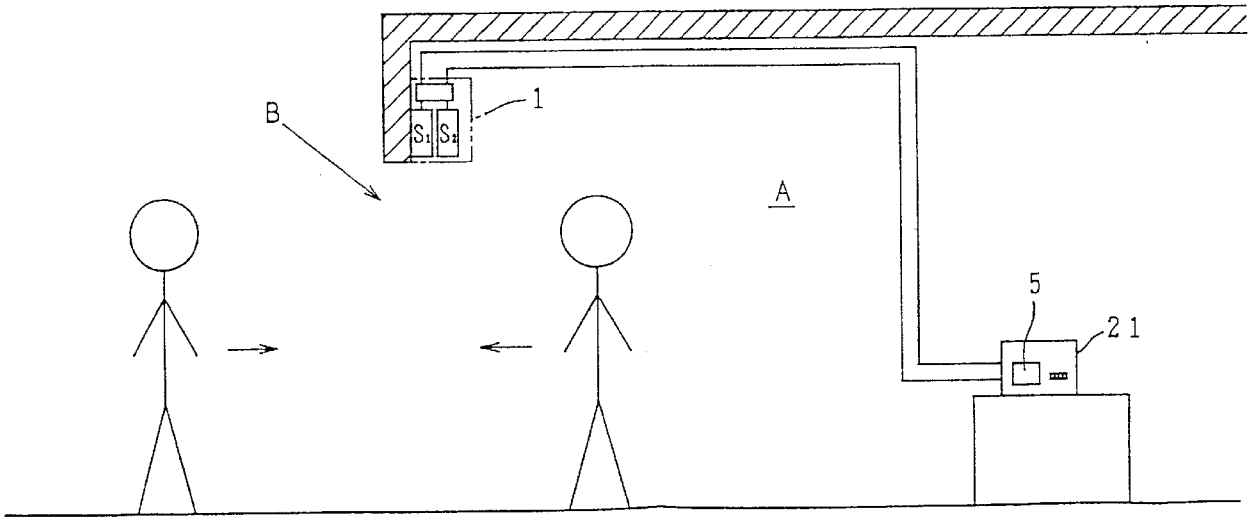
FIG. 3 is a flow chart which illustrates the processing steps utilized in the second embodiment.
Figure 4:
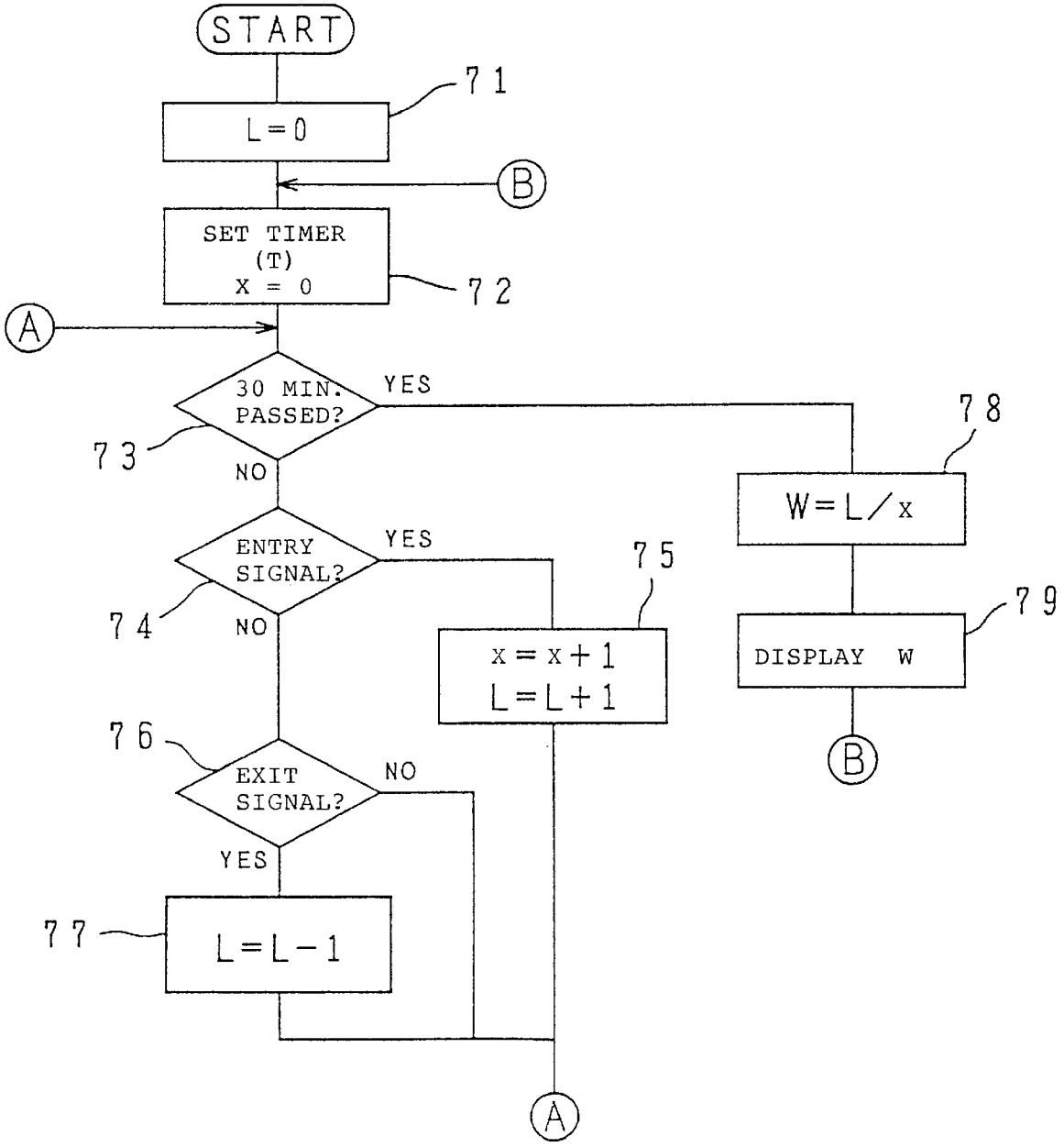
FIG. 4 is an explanatory diagram of conventional measuring device.
Figure 5:
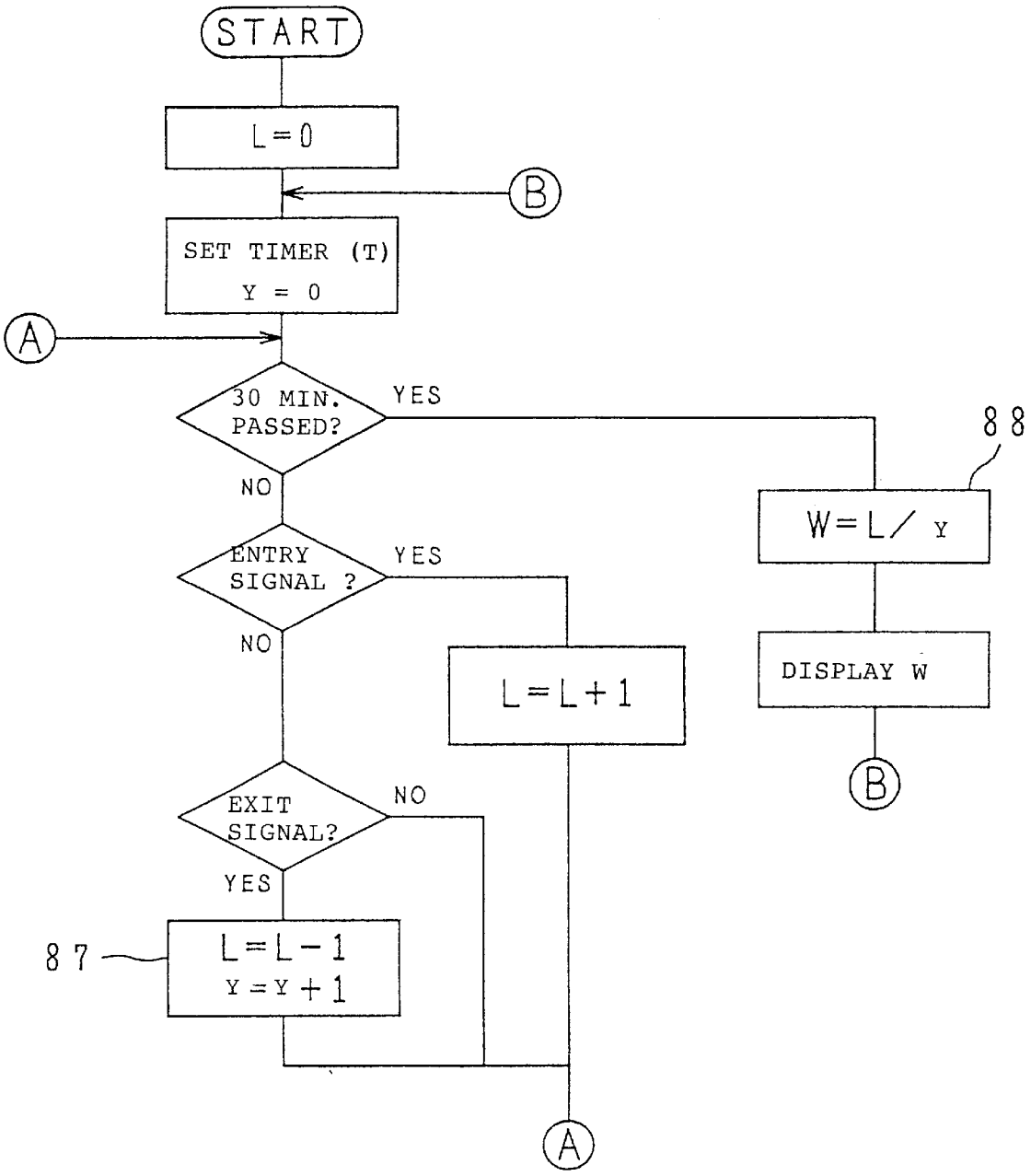
FIG. 5 shows a conceptual diagram of the waiting line theory.

A program which processes the entry and exit signals is described in the flow chart of FIG. 3. This flow chart shows an example in which the mean staying time of persons staying inside A of the establishment is calculated and displayed every 30 minutes.

The number of persons staying L is determined as in this embodiment using the calculation "Number of persons Y who have exited=Number of persons Y who have exited+1" when the exit signal is outputted from the entry/exit detector 1 (step 87). Every time the 30 minute period (the unit time) passes, the calculation "Mean staying time W=Number of persons L staying divided by Number of persons Y who have exited {W=L/Y}" is performed by the use of the number of persons L who are staying and the number of persons Y who have exited (step 88). The resulted mean staying time W is outputted and displayed on the display 5.

A microcomputer performs the calculation "Number of persons staying L=Number of persons Y who have exited+1" by using the exit signals supplied from the entry/exit detector 1, and a section of the microcomputer that performs such a calculation is the "exit measuring means" which is described above where the principle of the present invention is described. Also, the section of the microcomputer that performs the step 88 {W=L/Y} is the "calculation means" that is also described above where the principle of the present invention is described.

We claim:

1. A device for measuring mean staying time of persons staying inside an establishment by processing signals provided by an entry/exit detection means that outputs an entry signal when a person entering into said establishment is detected and also outputs an exit signal when a person exiting from said establishment is detected, said device comprising:

a staying measuring means which determines a number of persons staying inside said establishment by subtracting the number of exit signals from the number of entry signals;

an exit measuring means which determines a number of persons who have exited from said establishment per predetermined unit time by counting exit signals per said unit time; and a calculation means which calculates a mean staying time of persons staying in said establishment during said unit time by dividing the number of persons staying that is outputted by said staying measuring means at the time said unit time has passed by the number of persons who have exited that is outputted by said exit measuring means.

2. A device according to claim 1, further comprising a display connected to said calculating means for displaying said mean staying time.

* * * * *